United States Patent [19]

Craig

[11] Patent Number: 5,007,073

[45] Date of Patent: Apr. 9, 1991

[54] METHOD AND APPARATUS FOR OBTAINING A SELECTABLE CONTRAST IMAGE IN AN X-RAY FILM

[75] Inventor: James R. Craig, Glenview, Ill.

[73] Assignee: Gendex Corporation, Franklin Park, Ill.

[21] Appl. No.: 454,029

[22] Filed: Dec. 20, 1989

[51] Int. Cl.[5] ..... H05G 1/32

[52] U.S. Cl. ..... 378/112; 378/111

[58] Field of Search ..... 378/112, 111

[56] References Cited

U.S. PATENT DOCUMENTS 4,439,868 3/1984 Makino et al. ..... 378/112
4,797,908 1/1989 Tanaka et al. ..... 378/112
4,831,642 5/1989 Chattin ..... 378/108
4,851,983 7/1989 Chattin ..... 363/136

*Primary Examiner*—Craig E. Church
*Attorney, Agent, or Firm*—Roger J. French

[57] ABSTRACT

The invention provides a method and apparatus for obtaining a selectable contrast image in an X-ray exposure. The method comprises applying a controlled high voltage to an X-ray tube in response to a controlled invertor-generated voltage; generating the controlled invertor-generated voltage; driving the invertor in response to a KV control signal; comparing a KV feedback signal with a KV reference signal for developing said KV control signal, and selecting any of a plurality of variable level reference signals as the KV reference signal. The apparatus comprises means for carrying out the foregoing method.

12 Claims, 2 Drawing Sheets

FIG. 2
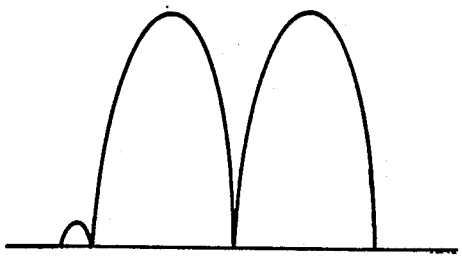
FIG. 3
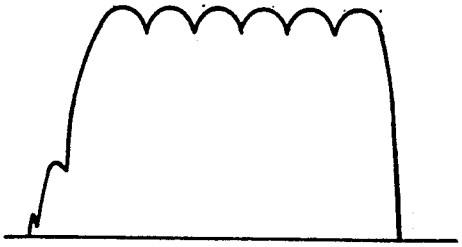
FIG. 4
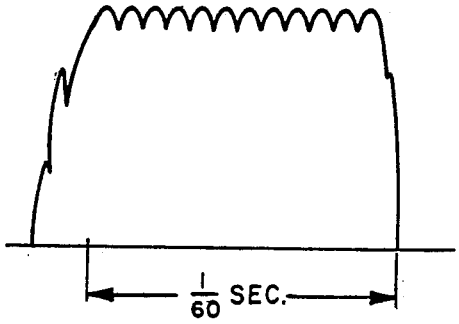
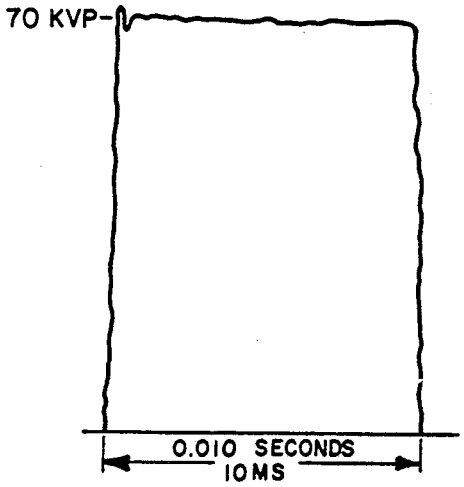
FIG. 5
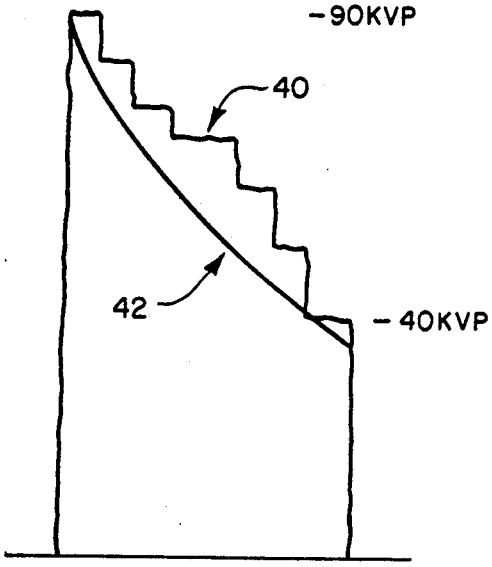
FIG. 6

METHOD AND APPARATUS FOR OBTAINING A SELECTABLE CONTRAST IMAGE IN AN X-RAY FILM

BACKGROUND OF THE INVENTION

The invention is directed to the field of diagnostic X-ray imaging apparatus, and more particularly to a novel and improved method and apparatus for obtaining a selectable contrast image in a diagnostic X-ray exposure.

Diagnostic X-ray imaging apparatus has traditionally provided a program and technique, often presented on a chart, which allows a selection of three key factors prior to each exposure in an effort to optimize the levels of contrast in each exposure. These factors are (1) KVP - the peak kilovoltage (KV) applied to the X-ray tube during exposure; (2) MA - the milliamperes current forced through the X-ray tube in response to the selected KVP; and (3) time - the number of seconds, from on the order of tens of milliseconds up to on the order of ten seconds of duration of the exposure. More recently, the combined milliamperes and seconds are being combined in a term MAS, which refers to the multiplication product of the milliamperes times the seconds.

The KVP has two effects on the diagnostic value or exposure of the film. The peak KV value determines the penetrating power of the X-ray beam and also affects film-blackening. The MA or MAS determines the intensity of the beam, with total blackening of the film being directly proportional to the time of exposure.

A proper selection of these two (KVP and MAS) factors will produce an exposure of the film in varying levels of black and white contrast, forming an image of all parts of the body through which the X-rays have passed. That is, the various gradations of black and white exposure levels on the film will create a picture or image of the various body parts. This gradation may extend from an almost total black exposure for areas outside of the body part being imaged to a clear and virtually unexposed transparent film area for those body parts which are so dense that they totally absorb all X-rays that enter. In between the total black and clear or transparent areas, the gradations of film density provide diagnostic details in the form of variations of film density or black/white contrast levels.

In most X-ray generators heretofore, the KVP is determined by the voltage to the primary side of a high voltage generator circuit (allowing for voltage drops due to the regulation of the system). The earliest systems were single-phase, full-wave rectified, essentially giving a KVP waveform which converts a 60 Hz sine wave signal to two positive half-waves per cycle and transforms the voltage levels to the desired KVP voltage. Regardless of the KVP selected, the radiation exposure spectrum contained energies at all wavelengths from the lowest usable KV level (on the order of 30–40 KV) up to the KVP level selected by the operator. Hence as the KV level rises sinusoidally in these older systems, it first produces contrast on the exposure on the softer and less dense areas of the body part being imaged and continues to increase penetration into denser areas progressively. This relatively broad band of energy therefore permitted the X-ray film to display a relatively broad range of contrast for a given KVP setting. The greater the contrast of a film exposure, the easier it is, in theory, to visualize small density differences. As the KVP setting is increased, the range of contrast tends to be reduced, since it is the amount of relatively low level energy, produced by the lower KV levels, that determines the contrast range.

However, the foregoing single-phase system is highly inefficient by today's standards, and delivers an excessive amount of X-ray energy to the patient during the exposure. Later X-ray systems developed a three-phase technology designed to eliminate this waste of energy and excessive exposure. These three phase X-ray systems produced a waveform with very little energy at the lower kilovoltages, which greatly improve generator efficiency as compared to single phase. That is, instead of two sine waves per cycle, there were now six pulses interwoven in a mesh that eliminated much of the wasted energy in a single-phase system. However, the lowest KV level on any exposure was now only on the order of eighty percent of the peak KV value for the exposure. This resulted in a reduction of contrast in the exposure which was accepted as a trade-off for the higher efficiency. This means that smaller gradations of density are harder to identify in the exposed film, which may make diagnosis more difficult. Finally, with the development of high frequency X-ray generators, exposures are made at an almost constant kilovoltage level with very little "soft" radiation. In such systems, the efficiency is greatly improved by the use of high frequency switching which provides precise timing, precise duplication of exposures from one exposure to the next, and shortened exposure times. In high frequency generators, the kilovoltage at the generator is monitored and compared to a selectable, fixed reference voltage. Any resultant difference voltage is used to directly regulate the kilovoltage. As the reference voltage is changed by the operator, the kilovoltage changes correspondingly to a new level; that is, in a closed-loop type of system.

However, each improvement has further reduced the proportion of the lower KV levels to the selected KVP and therefore reduced the overall contrast of the image. However, because these changes have taken place over a long period of time, this gradual reduction in contrast has been generally accepted by diagnosticians.

OBJECTS AND SUMMARY OF THE INVENTION

It is therefore an object of the present invention to provide a novel and improved apparatus for obtaining a selectable and greatly improved contrast in an X-ray image.

Briefly, in accordance with the foregoing object, the present invention provides a method and apparatus for obtaining a selectable contrast image in an X-ray exposure. The method comprises applying a controlled high voltage to an X-ray tube in response to a controlled invertor-generated voltage; generating said controlled invertor-generated voltage; driving said invertor in response to a KV control signal; comparing a KV feedback signal with a KV reference signal for developing said KV control signal, and selecting any of a plurality of variable level reference signals as said KV reference signal. The apparatus comprises means for carrying out the foregoing method.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

FIGS. 2, 3 and 4 are respective waveform diagrams of the KV waveforms obtainable with earlier systems;

FIG. 5 is a waveform diagram of a typical KV waveform obtainable with a modern high-frequency generator system; and FIG. 6 is an exemplary diagram of a KV waveform obtainable with a system in accordance with the present invention.

DETAILED DESCRIPTION OF THE ILLUSTRATED EMBODIMENT

Figure 1:
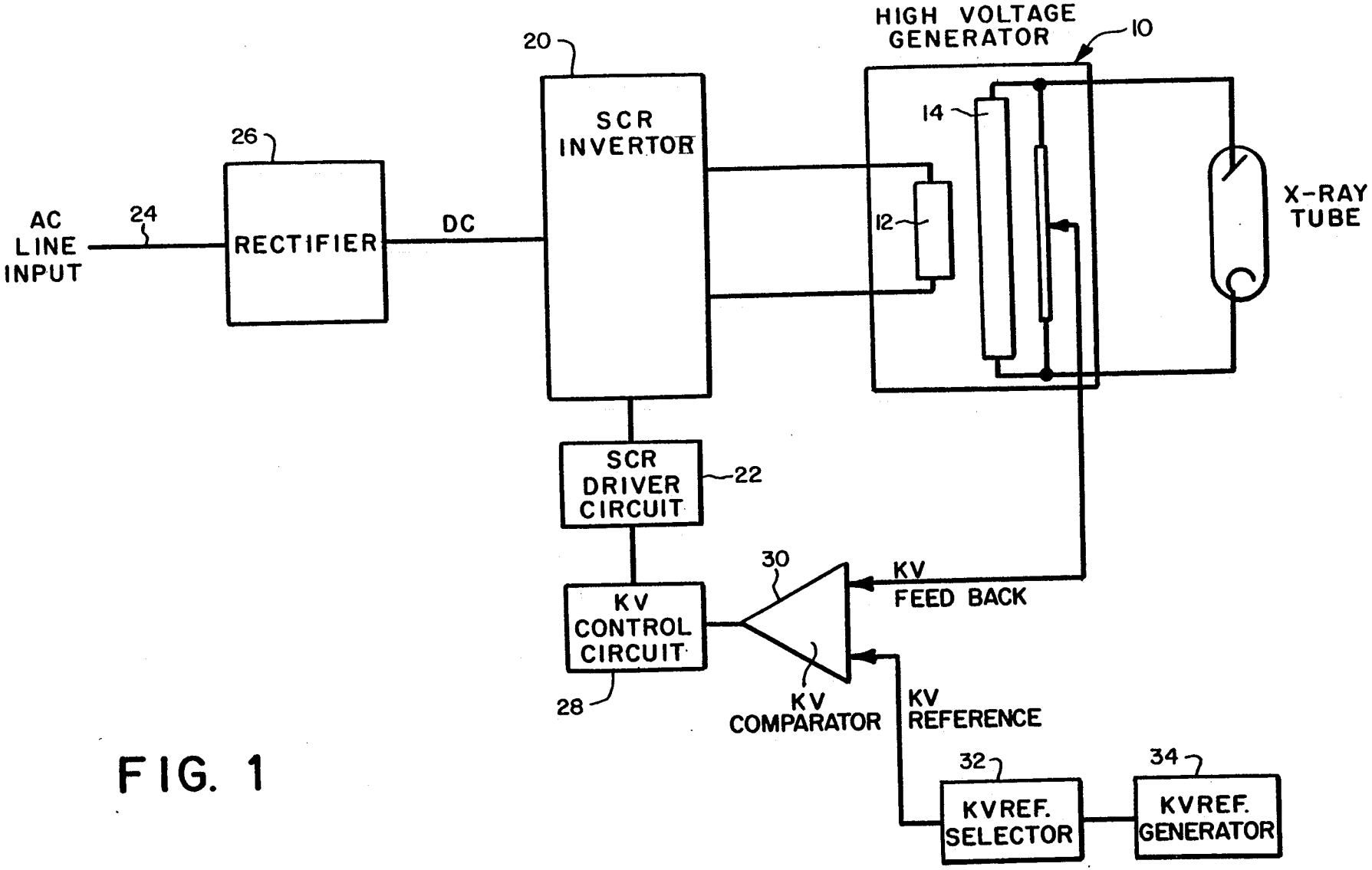
FIG. 1 is a functional block diagram of an X-ray apparatus utilizing the method in accordance with the invention.

Referring now to the drawings, and initially to FIG. 1, the method and apparatus of the invention are illustrated in block diagrammatic form. In accordance with the invention, the apparatus of FIG. 1 includes a high-voltage generator circuit means 10 which includes high voltage primary means 12 for receiving a controlled voltage and a high voltage secondary means 14 for applying a controlled high voltage to an X-ray tube 16.

An invertor circuit means 20 which, in the illustrated embodiment, is an SCR invertor circuit is provided for generating and applying the desired controlled voltage to the primary means 12. An SCR driver circuit 22 is responsive to a KV control signal for driving the invertor circuit means 20.

A high voltage DC power is provided to the SCR invertor circuit 20 from an AC line input 24 by a high voltage rectifier circuit 26. The SCR driver circuit 22 thus drives or controls the application of the high voltage DC to the primary of the high-voltage generator by the SCR invertor circuit 20.

The KV control signal for the SCR driver circuit 22 is received from a KV control circuit 28 which receives an appropriate KV control signal from a KV comparator circuit means 30. The KV comparator circuit means 30 compares a KV feedback signal from the high voltage generator circuit means with a KV reference signal and develops the KV control signal in accordance with this comparison.

The details of structure and operation of the foregoing circuits are preferably as shown and described in U.S. Pat. Nos. 4,831,642 and 4,851,893.

In accordance with the invention, the KV reference signal is provided by KV reference signal selector circuit means 32 which selects from a KV reference generator circuit means 34 any of a plurality of fixed level reference signals and a plurality of variable level reference signals for application to the KV comparator circuit means 30. The reference signal generating circuit means generates a plurality of KV reference signals which comprise a plurality of fixed DC levels, each proportional in a predetermined manner to a corresponding desired KV level, and also a plurality of both stepped variable and continuous variable reference levels.

Referring briefly to FIG. 6, a stepped or step-wise variable KV reference level 40 is illustrated. However, it will be recognized that the KV reference signal could form a continuous curve such as curve 42 and thus form what is referred to herein as a "continuous" variable reference level. It should be recognized that the stepped signal 40 and the continuous signal 42 may take any desired form, in addition to the forms shown herein for purposes of illustration, without departing from the invention.

As mentioned hereinabove, the invention provides a greatly improved and selectable contrast image in an X-ray film.

Accordingly, a method is presented in which a controlled high voltage is applied to the X-ray tube 16 in response to a controlled, invertor generated voltage. The method contemplates generating this controlled invertor-generator voltage in response to a drive signal which is developed in response to a KV control signal.

This KV control signal is developed by comparing a KV feedback signal from the high voltage generator 10 with a KV reference signal selected in accordance with the invention by selector 32 from among a plurality of either fixed level or variable level reference signals generated by KV reference generator 34.

Referring now to the remaining figures of drawings, some of the advantages of the present invention over prior systems will be better appreciated. As mentioned hereinabove, early single phase X-ray equipment developed a KV waveform generally of the form illustrated in FIG. 3; that is, by a single phase sine wave. The AC signal was rectified to develop two positive half-waves per cycle as shown in FIG. 3. Thus, regardless of the KVP selected, at each 1/120 second, the voltage started at zero, rose in a smooth sine wave to the programmed KVP and then returned to zero in the same sine wave pattern.

Later, 3-phase X-ray systems developed essentially six interlaced pulses per cycle as shown in FIG. 4. That is, three sine waves of the type shown in FIG. 3 were rectified to form six interlaced positive half-pulses, thus forming a somewhat smoother KVP level and improving the efficiency of the generator by eliminating much of the wasted energy in the single phase system, in reaching the selected KVP level.

As shown in FIG. 5, the three-phase technology was further defined to develop a twelve pulse KV waveform; that is, a threephase system further enhanced by twelve pulse secondaries on the auto transformers.

Finally, as shown in FIG. 6, the present high-frequency type of generators converted the 60 Hz AC power to very high frequencies such as on the order of 12 KHz. This also brought about a great reduction in size and weight of the generator power units. Operating at 12 KHz, the functions of the generator can be anticipated and processed at relatively high speeds. Hence, the high frequency generators generate a KVP waveform essentially as shown in FIG. 6, in which 95 percent or more of the consumed power is converted to the diagnostic X-ray spectrum. Although designs may vary, most designs are quite capable of keeping the KVP within two percent or less of the selected peak value throughout the exposure. In essence, the automatic control of the KVP corrects the KVP up to 12,000 times a second. However, present X-ray generators control the KVP waveform by comparing the KV feedback signal with a selectable, but fixed reference voltage. That is, a single fixed reference voltage is selected in advance for each exposure.

In contrast, the present invention takes advantage of the relationship between the KV feedback signal and the operator selected reference voltage. In present high frequency generators, this reference level is constant throughout the exposure. This, in turn, results in a relatively limited contrast available in the exposure and resulting image. That is, since there is very little "soft" radiation (much less lower level KV) in the KV waveform shown in FIG. 6, there is very little variation in the contrast of the image produced. Because the KVP is selected to give some contrast, even at the densest tissue being imaged, hardly any intermediate energy levels are present for contrasting tissues of different density within the same exposure.

In contrast, with the system of the invention, a continuous or step-wise variable KV reference level is utilized, resulting in a KV waveform of the form shown in FIG. 1. Since the reference level is thereby varied during the exposure, the kilovoltage will track that change. This tracking permits any one exposure to have a number of different kilovoltages, and thereby have varying levels of contrast for accommodating the different densities of tissues which may be present in the areas being imaged.

For example, in radiographic chest film, the conventional practice is to provide a low enough KVP to get contrast through the soft parts of the chest, and still be high enough to penetrate muscles and detect problems in the ribs. With the present invention, the exposure can be programmed to have a near optimum contrast at every density level present, and still make the total exposure with the same efficiency, accuracy and within the same time. Moreover, since the KVP can be varied in a step-wise or continuous downward fashion as shown in FIG. 7, in theory the exposure may now be started at a higher KVP than with the more or less constant KV level as shown in FIG. 6. This will therefore improve the penetration and contrast of the denser parts. The relatively higher levels present initially will be offset by the lower levels later so as to keep the time and patient exposure essentially the same for a given film and image.

The present invention can also be used in dual-, or multi-kilovoltage systems with digital sensors, in which the two or more images at the two or more energies are stored in a digital memory, and then manipulated to remove unwanted information; i.e., dual energy subtraction.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. Apparatus for obtaining a selectable contrast image in an X-ray film comprising: high voltage generator circuit means having high voltage primary means for receiving a controlled voltage and high voltage secondary means for applying a controlled high voltage to an X-ray tube; invertor circuit means coupled with said high voltage generator circuit means for applying said controlled voltage to said primary means; driver circuit means responsive to a KV control signal for driving said invertor circuit means such that the voltage applied to said X-ray tube during an exposure is at a level determined by said KV control signal; KV comparator circuit means for comparing a KV feedback signal from said high voltage generator circuit means with a KV reference signal and for developing said KV control signal in accordance with said comparison; and reference signal selector circuit means for selecting any of a plurality of variable level KV reference signals which change in level during an exposure for application to said KV comparator circuit means.

2. Apparatus according to claim 1 and further including reference signal generating circuit means coupled with said reference signal selector circuit means for generating a plurality of KV reference signals comprising a plurality of both stepped variable and continuous variable reference levels.

3. Apparatus according to claim 2 wherein said selector circuit means further includes means for selecting any of a plurality of fixed reference level signals for application to said KV comparator circuit means.

4. Apparatus according to claim 3 wherein said reference signal generating circuit means further includes means for generating a plurality of KV reference signals comprising a plurality of fixed DC levels proportional in a predetermined manner to a plurality of desired KV levels.

5. A method for obtaining a selectable contrast image in an X-ray film comprising: applying a controlled high voltage to an X-ray tube in response to a controlled invertor-generated voltage; generating said controlled invertor-generated voltage; driving an invertor circuit which generates said controlled invertor-generated voltage in response to a KV control signal such that the voltage applied to said X-ray tube during an exposure is at a level determined by said KV control signal; comparing a KV feedback signal with a KV reference signal for developing said KV control signal, and selecting any of a plurality of fixed level reference signals and a plurality of variable level reference signals which change in level during an exposure as said KV reference signal.

6. A method according to claim 5 and further including generating a plurality of KV reference signals comprising a plurality of both stepped variable and continuous variable reference signals.

7. A method according to claim 6 and further including selecting any of a plurality of fixed level reference signals as said KV reference signal.

8. A method according to claim 7 and further including generating a plurality of KV reference signals comprising a plurality of fixed DC levels proportional in a predetermined manner to a plurality of desired KV voltages.

9. An improvement in an apparatus for obtaining a selectable contrast image in an X-ray film, said apparatus including a high voltage generator circuit having a high voltage primary for receiving a controlled voltage and a high voltage secondary for applying a controlled high voltage to an X-ray tube; and invertor circuit coupled with said high voltage generator circuit for applying said controlled voltage to said primary; a driver circuit responsive to a KV control signal for driving said invertor circuit such that the voltage applied to said X-ray tube during an exposure is at a level determined by said KV control signal, and a KV comparator circuit for comparing a KV feedback signal from said high voltage generator circuit with a KV reference signal and for developing said KV control in accordance with said comparison; wherein said improvement comprises: a reference signal selector circuit for selecting any of a plurality of variable level KV reference signals which change in level during an exposure for application to said KV comparator circuit.

10. The improvement according to claim 9 and further including reference signal generating circuit means for generating a plurality of KV reference signals comprising a plurality of both stepped variable and continuous variable reference levels.

11. The improvement according to claim 10 wherein said reference signal selector circuit further includes means for selecting any of a plurality of fixed level reference signals for application to said KV comparator circuit.

12. The improvement according to claim 11 wherein said reference signal generating circuit means further includes means for generating a plurality of KV reference signals comprising a plurality of fixed DC levels proportional to a plurality of KV levels.

* * * * *